US005490636A

United States Patent [19]

Schrödl

[11] Patent Number: 5,490,636

[45] Date of Patent: Feb. 13, 1996

[54] ROTARY JAW CRUSHER

[76] Inventor: Hermann Schrödl, Vornwald 7, A-4713 Gallspach, Austria

[21] Appl. No.: 316,561

[22] Filed: Sep. 30, 1994

Related U.S. Application Data

[63] Continuation of Ser. No. 113,527, Aug. 27, 1993, abandoned, which is a continuation of Ser. No. 822,442, Jan. 17, 1992, abandoned.

[30] Foreign Application Priority Data

Jan. 21, 1991 [AT] Austria ..... 1/21/91

[51] Int. Cl.[6] ..... B02C 13/00

[52] U.S. Cl. ..... 241/189.1; 241/239; 241/241.5; 241/242

[58] Field of Search ..... 241/237, 239, 241/242, 189.1, 241.5

[56] References Cited

U.S. PATENT DOCUMENTS

| | | | |
|---|---|---|---|
| 1,185,937 | 6/1916 | Rapp | 241/241.5 |
| 1,436,208 | 11/1922 | Sprague | 241/242 |
| 2,216,612 | 10/1940 | Dimm et al. | 241/237 |
| 3,612,415 | 10/1971 | Merges | 241/189.1 |
| 4,340,185 | 7/1982 | Braun et al. | 241/189.1 |

FOREIGN PATENT DOCUMENTS

| | | | |
|---|---|---|---|
| 0042575 | 6/1910 | Austria | 241/241.5 |
| 0468882 | 7/1914 | France | 241/241.5 |
| 2580193 | 10/1986 | France . | |
| 0472240 | 2/1929 | Germany | 241/241.5 |
| 0002092 | of 1867 | United Kingdom | 241/241.5 |

*Primary Examiner*—Richard K. Seidel
*Assistant Examiner*—Allan M. Schrock
*Attorney, Agent, or Firm*—Collard & Roe

[57] ABSTRACT

A rotary jaw crusher comprises a rotor, which carries at least one revolving jaw and rotates within a housing about a horizontal axis of rotation, and a stationary jaw, which is fixed to the housing and is substantially disposed above the descending portion of the flight circle of the rotor and rises toward the charging opening of the housing opposite to the sense of rotation of the rotor with a small inclination from the horizontal and is provided with crushing bars or the like, which protrude toward the rotor. In order to achieve a high efficiency and a low susceptibility to wear, crushing bars having sharp edges are provided on the stationary jaw and extend approximately normal to the axis of rotation of the rotor.

2 Claims, 4 Drawing Sheets

13
11
2a
12
10
18
3
2
1
11
19a
III
19
III
8
9
14
19
7
A
α
15
6
5
17
7
8
16
9
4

13
11
2a
18
12
10
3
1
2
11
18a
19a
19
8
9
14
7
19
15
6
5
17
7
8
16
9
4

ROTARY JAW CRUSHER

This is a continuation of application Ser. No. 08/113,527, filed Aug. 27, 1993, now abandoned, which is a continuation of application Ser. No. 07/822,442, filed Jan. 17, 1992, now abandoned.

BACKGROUND OF THE INVENTION

1. Field of the Invention

This invention relates to a rotary jaw crusher comprising a rotor, which carries at least one revolving jaw and rotates within a housing about a horizontal axis of rotation, and a stationary jaw, which is fixed to the housing and is substantially disposed above the descending portion of the flight circle of the rotor and rises toward the charging opening of the housing opposite to the sense of rotation of the rotor with a small inclination from the horizontal and is provided with crushing bars or the like, which protrude toward the rotor.

2. Description of the Prior Art

FR-A 2,580,193 discloses impact crushers comprising similar rotors and a baffle plate, which is provided with crusher bars, which extend parallel to the axis of rotation of the rotor and constitute baffle members having no sharp edges. In such impact crushers a disintegration is effected as the material which has been thrown away from the rotor impinges on the baffle surfaces and crushing bars of the baffle plate so that the operation involves a rather high wear and is performed with only a relatively low efficiency because the disintegration involves a high proportion of work of motion and work of friction.

In addition to impact crushers, jaw crushers are known, in which two crushing jaws swinging relative to each other cooperate to disintegrate material between them. Such crushing jaws may be provided with sharp edges, which extend in the vertical direction. The disintegrating action can be improved in that such crushing jaws are provided with vertically extending sharp edges but in that case the disintegrating performance is only small because the motion of the jaws is reversed and the cycle frequency and the stroke length are limited in smite of a high mower input.

On the other hand, hammer mills are disintegrating machines comprising rotors, which are provided with pivoted hammers, and baffle plates associated with said rotors. The baffle plates may carry protruding tearing fingers, between which the hammers of the rotor move as they blow. But owing to the relatively low impact energy of their hammers such hammer mills cannot be used to disintegrate large pieces of hard rock.

SUMMARY OF THE INVENTION

For this reason it is an object of the invention to provide a rotary jaw crusher which is of the kind described first hereinbefore and which combines the functions of a jaw crusher and an impact crusher and has a very good disintegrating performance at high efficiency and a low susceptibility to wear.

That object is accomplished in accordance with the invention in that the stationary jaw is provided with crushing bars, which extend approximately at right angles to the axis of rotation of the rotor and are provided with sharp edges. It has been found that even large and hard pieces will be crushed under high compressive stresses even if the compressive force acts only for a short time on a small surface portion of such piece. By the crushing bars provided with sharp edges, the rotational energy of the rotor can be applied to the material while it is substantially at rest and said energy can thus be converted to high compressive stresses so that the desired disintegrating action is achieved quickly and effectively and is substantially independent of the initial particle size of the material and the motion of the material within the housing will be minimized. A high efficiency is achieved, the wear is low and dust is raised only to a limited extent.

If the stationary jaw in addition to the sharp-edged crushing bars is provided with chisellike crushing teeth, which are mounted between and/or on the crushing bars, the impact of said crushing teeth on the material to be crushed will give rise to peak stresses, which will increase the action tending to burst the material and will result in a high disintegration performance even if the energy is low. Besides, the crushing teeth may hold the material in position as it is disintegrated and may prevent substantial movements of the material.

If crushing bars are provided which differ in height and/or length, the sharp edges of such crushing bars will consecutively rather than simultaneously impinge on the material to be disintegrated so that the compressive stresses which can be generated by each sharp edge and the disintegrating action will be increased. Similar results will be produced if the crushing teeth protrude beyond the sharp edges of the crushing bars so that the crushing teeth will become effective before the sharp edges.

The crushing bars desirably extend toward the charging opening beyond that portion of the stationary jaw which is provided with crushing teeth because in that case the material which has been charged is guided and may be predisintegrated as it is charged.

If the revolving jaws are provided with radial cutting teeth, which are arranged to cooperate with the crushing teeth of the stationary jaw, peak stresses will be produced in the material to be disintegrated not only by the crushing teeth But also by the cutting members carried by the rotor and the disintegrating action will thus be accelerated and intensified.

The disintegrating action is also increased by the fact that the shard edges of the crushing bars have sawtooth-shaped indentations so that the impact of the shard edges on the material to be disintegrated will give rise to compressive stresses of different intensities and the bursting action is increased.

To minimize Dower losses, the material to be disintegrated should be held in position as firmly as possible as it is crushed. That retention of the material can be improved if, in accordance with the invention, the crushing teeth have leading ends formed with crushing edges, which face the charging opening and are inclined from the horizontal by an angle of more than 30 degrees, preferably by an angle of 40 to 80 degrees, so that the material which has been charged can be directed into the wedge-like gad between the flight circle of the rotor and the stationary jaw.

The retaining and crushing actions can also be improved in that a straight-line continuation of the crushing edge of the uppermost crushing member motionally intersects the flight circle of the rotor in an arc section which extends from the apex of the flight circle through 20 degrees in the sense of rotation of the rotor and through 90 degrees opposite to said sense, or said continuation may extend entirely above the flight circle. With that arrangement of the crushing edges the material can properly be engaged already in the receiving region and can be forwarded for a proper crushing action.

BRIEF DESCRIPTION OF THE DRAWING

The subject matter of the invention is diagrammatically schematically represented in the drawings.

DETAILED DESCRIPTION OF THE PREFERRED EMBODIMENTS

Figure 1:
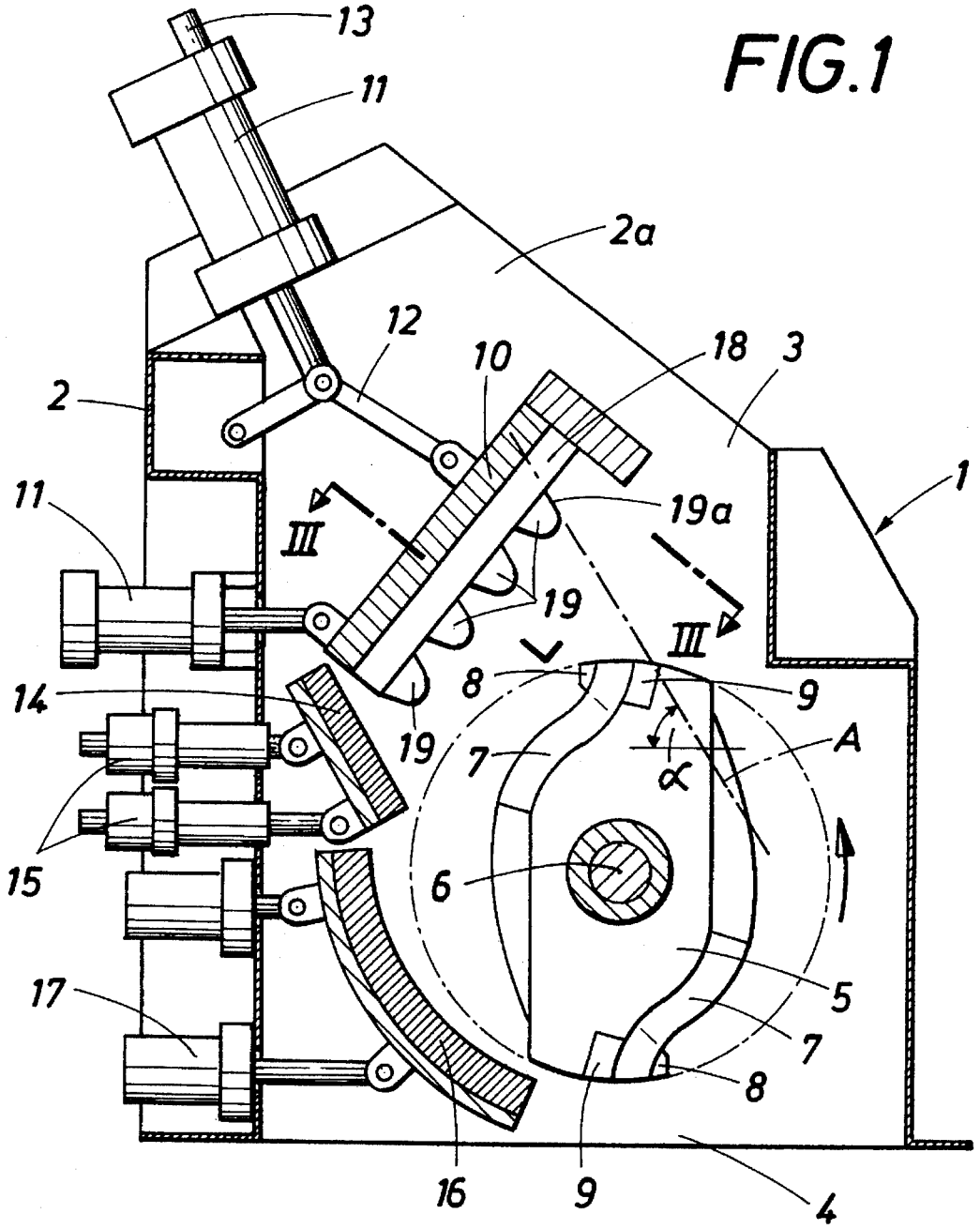
FIGS. 1 and 2 are vertical sectional views showing two illustrative embodiments of a rotary jaw crusher in accordance with the invention viewed on a plane which is at right angles to the axis of rotation of the rotor, FIG. 1 being a section along line I—I of FIG. 3.
Figure 1A:
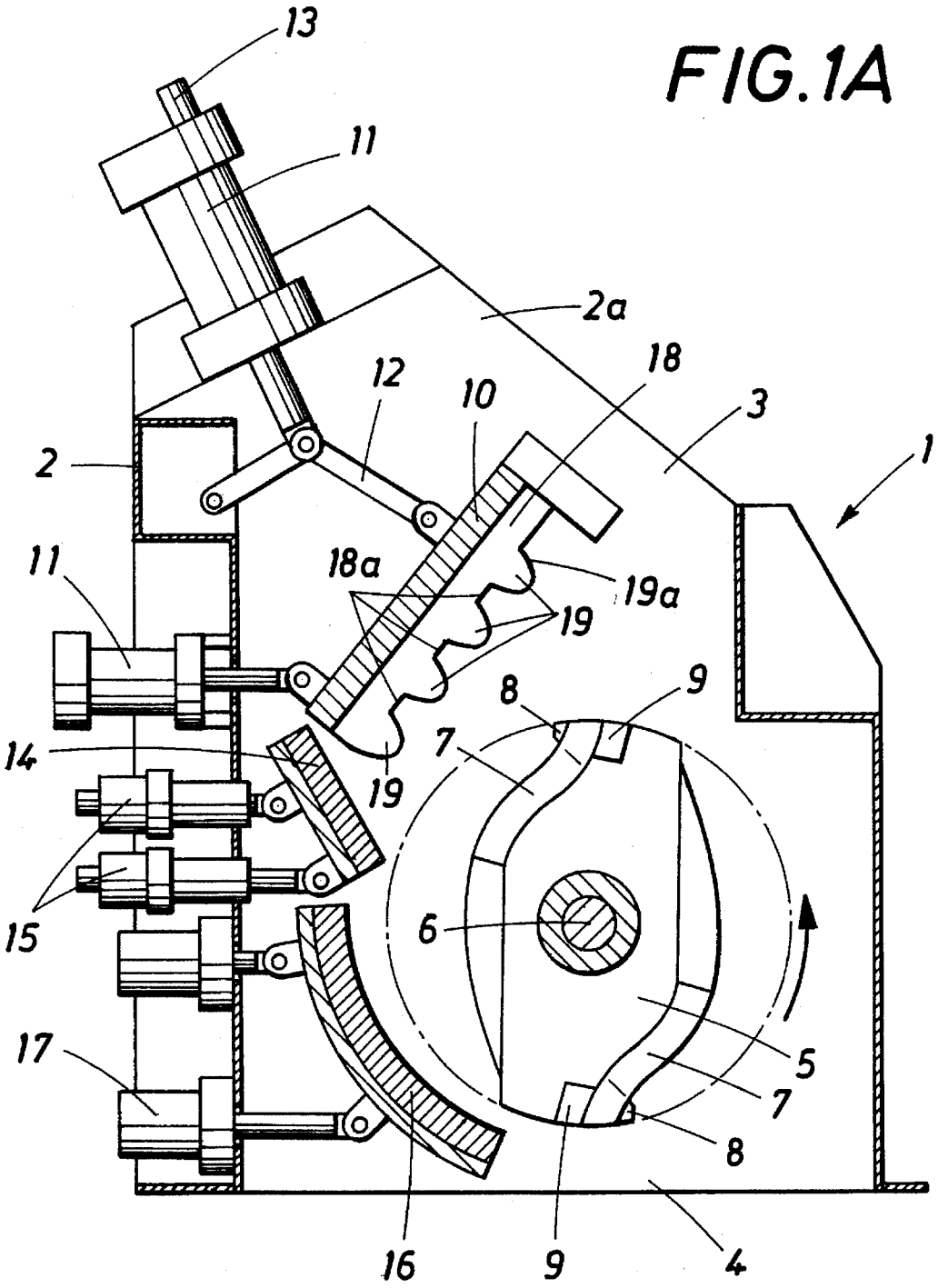
FIG. 1A is a sectional view taken along line IA—IA of FIG. 3.

The rotary jaw crusher i in accordance with the invention comprises a machine housing 2, which defines at the top a charging opening 3 and at the bottom an ejection opening 4. A rotor 5 is mounted in the machine housing 2 for rotation about a horizontal axis 6 and is provided with fixedly mounted revolving jaws 7 having radial cutting teeth 8 and striking bars 9, which are parallel to the axis of rotation. A stationary jaw 10, which is fixed to the housing, cooperates with the revolving jaws 7 and extends substantially entirely above the descending portion of the flight circle of the rotor transversely between the side walls 2*a* of the housing and rises toward the charging opening 3 opposite to the sense of rotation of the rotor at an acute angle to the horizontal. The stationary jaw 10 is supported in an adjustable position by means of suitable hydraulic actuators 11 and linkages 12. A merely schematically indicated pressure-relief valve 13 permits an adjustment of the maximum pressure in the hydraulic system and prevents an overload.

A grinding plate 14 is disposed below the stationary jaw 10 and is adjustable in an adjustable position by adjusting means 15 and defines the throat between the stationary jaw 10 and the flight circle of the rotor. The grinding plate 14 may be succeeded by a curved grinding track 16, which serves for a redisintegration and the position of which can also be changed by adjusting means 17.

Figure 2:
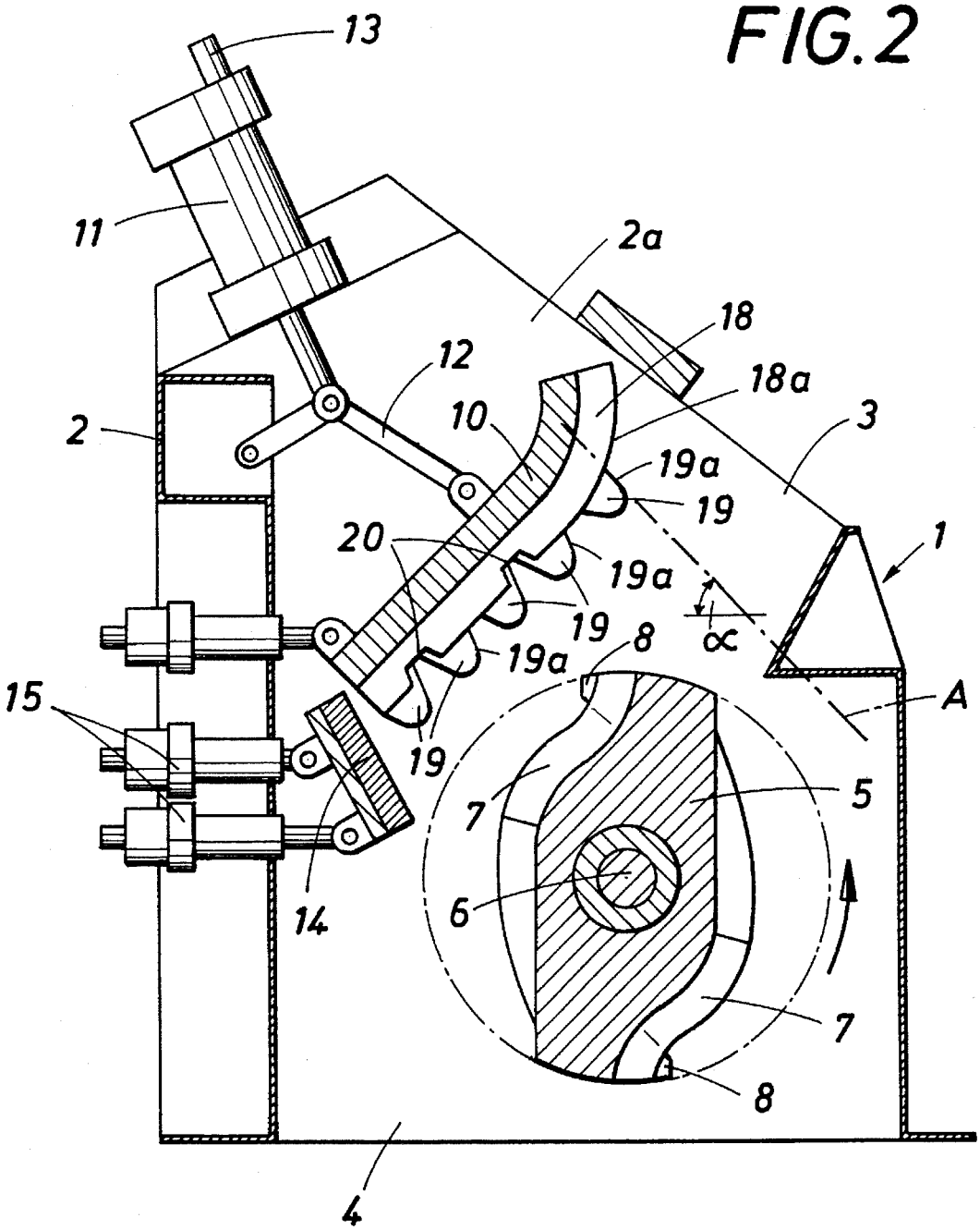
Figure 3:
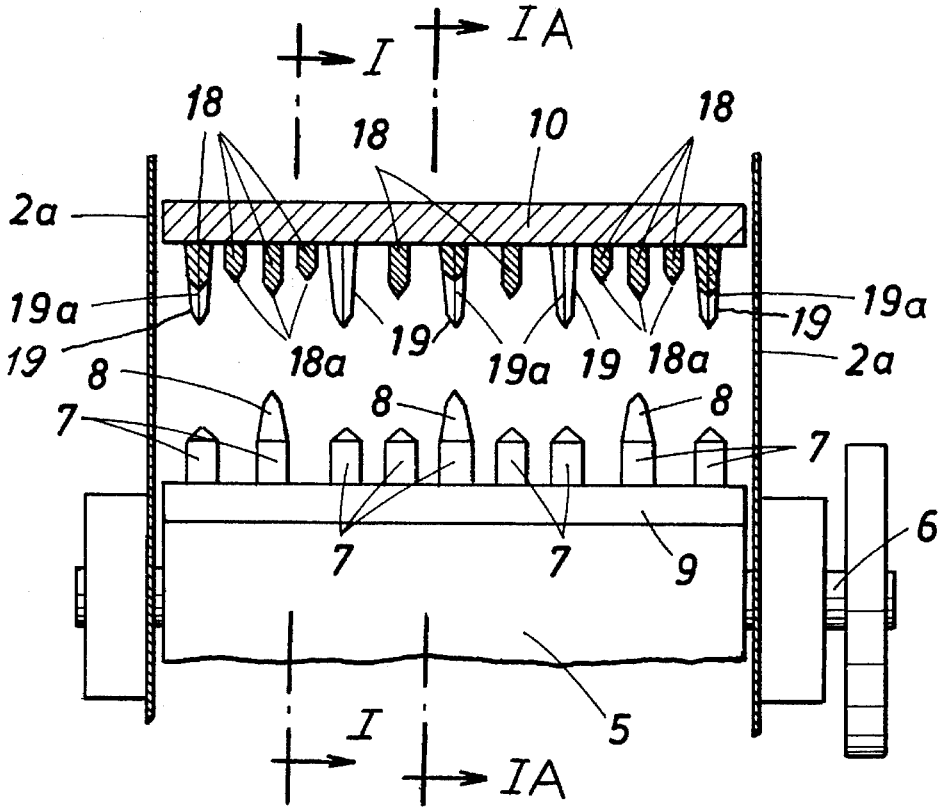
FIG. 3 is a transverse sectional view taken on line III—III in FIG. 1.
Figure 4:
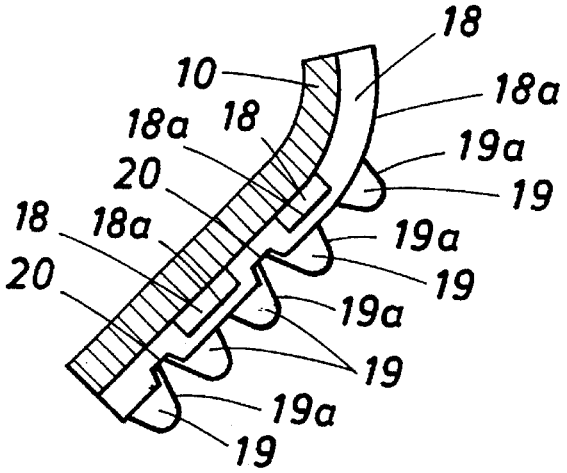
FIGS. 4 and 5 the sectional views showing two illustrative embodiments of the stationary jaw of that rotary jaw crusher viewed on a plane which is parallel to the crushing bars.
Figure 5:
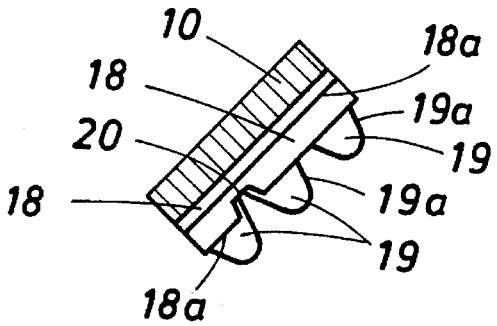

In order to ensure the desired disintegrating action, the stationary jaw 10 is provided with crushing bars 18, which are normal to the axis of rotation 6 of the rotor and have sharp edges 18*a*. In addition to the crushing bars, the stationary jaw is provided with chisel-like crushing teeth 19, which may be mounted on and/or between adjacent crushing bars 18. Certain ones of the crushing bars 18 differ in height and the crushing members 19 protrude beyond the sharp edges 18*a* of the crushing bars. Besides, the crushing bars 18 may have sawtooth-shaped indentations 20 and in dependence on the design of the machine housing 2 the crushing bars 18 may rise the charging opening 3 above the region provided with the crushing members (FIGS. 2 and 4).

During the operation of the rotary jaw crusher 1 the feed material is charged through the charging opening 3 and is received by the rotor 5, and by the revolving jaws 7 of the rotor is entrained and moved toward against the stationary jaw 10, where the feed material is forced against the sharp edges 18*a* of the crushing bars 18 and against the crushing members 19. The slight inclination of the stationary jaw 10 and the tapering gap between the rotor 5 and the stationary jaw 10 exert a progressively increasing entraining action so that the compressive stresses transmitted to the material increase until the material is crushed. Because the material is forced against the crushing bars 18 and the crushing teeth 19, the material cannot fly freely in the crushing space of the housing and is disintegrated quickly and effectively. That retaining action and, as a result, also the crushing action is improved by crushing edges 19*a*, which are provided at the leading ends of the crushing teeth 19 and are inclined through more than 30 degrees from the horizontal. Besides, if a straight-line continuation A of the sharp edge 19*a* of the uppermost crushing teeth 19 intersects the flight circle of the rotor it will desirably intersect said flight circle in an arc section which extends from the apex in the sense of rotation of the rotor through not more than 20 degrees and through 90 degrees opposite to said sense, so that the charged material can properly be gripped in the charging region already. The sufficiently disintegrated material then moves from the stationary jaw 10 in the sense of rotation of the rotor to the grinding plate 14 and flows from there to the grinding track 16, where redisintegration is optionally effected, and leaves the machine housing 2 through the ejection opening 4.

I claim:

1. A rotary jaw crusher comprising the combination of (a) a housing having a top charging opening, (b) a rotor mounted in the housing below the charging opening for rotation in a predetermined sense about an axis of rotation, the rotor carrying (1) at least one group of radially outwardly facing revolving jaws, the revolving jaws of each group being aligned in a direction extending parallel to the axis of rotation and each revolving jaw describing a predetermined flight circle upon rotation, the flight circles having an apex and a descending portion, and (c) a stationary jaw fixed to the housing and extending therein above the descending portion of the flight circles, the stationary jaw rising towards the charging opening opposite to the predetermined sense of rotation and at an acute angle of inclination from the horizontal, the stationary jaw carrying (1) crushing bars protruding toward the flight circles, each crushing bar having a longitudinal axis extending substantially over the length of the stationary jaw in a direction that is parallel to a line extending normal to the axis of rotation and a sharp edge facing the flight circles, the sharp edges of the crushing bars extending in a direction that is parallel to a line extending normal to the axis of rotation, and (2) chisel-like crushing teeth having a longitudinal axis extending perpendicularly to the longitudinal axes of the crushing bars, at least some of the crushing teeth being mounted on the crushing bars.

2. A rotary jaw crusher comprising the combination of (a) a housing having a top charging opening, (b) a rotor mounted in the housing below the charging opening for rotation in a predetermined sense about an axis of rotation, the rotor carrying (1) at least one group of radially outwardly facing revolving jaws, the revolving jaws of each group being aligned in a direction extending parallel to the axis of rotation and each revolving jaw describing a predetermined flight circle upon rotation, the flight circles having an apex and a descending portion, and (c) a stationary jaw fixed to the housing and extending therein above the descending portion of the flight circles, the stationary jaw rising towards the charging opening opposite to the predetermined sense of rotation and at an acute angle of inclination from the horizontal, the stationary jaw carrying (1) crushing bars protruding toward the flight circles and each crushing bar having a longitudinal axis extending substantially over the length of the stationary jaw in a direction that is parallel to a line extending normal to the axis of rotation and a sharp edge facing the flight circles, the sharp edges of the crushing bars extending in a direction that is parallel to a line extending normal to the axis of rotation, and (2) chisel-like crushing teeth, at least some of the crushing teeth being mounted between adjacent ones of the crushing bars.

* * * * *